US006539684B1

(12) United States Patent
Graham

(10) Patent No.: US 6,539,684 B1
(45) Date of Patent: Apr. 1, 2003

(54) CONCRETE BLOCK FOR ELEVATING AND RETAINING SURFACES

(75) Inventor: Gordon Graham, Brookfield (CA)

(73) Assignee: Innovative Block Inc., Antigonish ( * ) Notice: Subject to any disclaimer, the term of this patent is extended or adjusted under 35 U.S.C. 154(b) by 0 days.

(21) Appl. No.: 09/692,009

(22) Filed: Oct. 19, 2000

(30) Foreign Application Priority Data

Nov. 4, 1999 (CA) ..... 2288914
Jul. 25, 2000 (CA) ..... 2314417

(51) Int. Cl.[7] ..... E02D 5/20

(52) U.S. Cl. ..... 52/609; 52/604; 52/606; 52/20; 52/223.7; 52/610; 405/286; 405/284

(58) Field of Search ..... 52/604, 609, 596; 405/284

(56) References Cited

U.S. PATENT DOCUMENTS

| | | | | | |
|---|---|---|---|---|---|
| 3,686,873 | A | | 8/1972 | Vidal | |
| 4,190,384 | A | * | 2/1980 | Neumann | 405/284 |
| 4,244,665 | A | | 1/1981 | Neumann | |
| 4,909,010 | A | | 3/1990 | Gravier | |
| 5,072,566 | A | * | 12/1991 | Zeidman | 52/608 |
| D341,433 | S | * | 11/1993 | Rausch | D25/118 |
| 5,484,236 | A | * | 1/1996 | Gravier | 405/286 |
| 5,489,165 | A | * | 2/1996 | Smith | 405/284 |
| 5,505,034 | A | | 4/1996 | Dueck | |
| 5,564,865 | A | * | 10/1996 | Jansson | 405/286 |
| 6,113,318 | A | * | 9/2000 | Guth | 405/284 |

FOREIGN PATENT DOCUMENTS

| | | |
|---|---|---|
| CA | 2092303 | 3/1992 |
| CA | 2069178 | 11/1992 |
| CA | 2012286 | 3/1994 |
| CH | 657172 | 8/1986 |
| DE | 3232799 | 3/1984 |
| EP | 0320639 | 6/1989 |
| FR | 2743098 | 7/1997 |

* cited by examiner

*Primary Examiner*—Carl D. Friedman
*Assistant Examiner*—Basil Katcheves
(74) *Attorney, Agent, or Firm*—Katten Muchin Zavis Rosenman

(57) ABSTRACT

A concrete block comprised of a horizontal rearwardly extending surface of a suitable elevation and a vertically extending surface that extends an appropriate height above the horizontal surface, whereby the present invention allows for the association of vertical and horizontal structures and for the construction of aesthetically pleasing elevated surfaces and platforms, decorative steps and various stair and riser systems.

19 Claims, 7 Drawing Sheets

CONCRETE BLOCK FOR ELEVATING AND RETAINING SURFACES

FIELD OF THE INVENTION

The present invention relates to a concrete block structure particularly directed to the construction of stair or riser systems, such that the present block structure provides a horizontal planar ledge surface that can elevate and support other block or brick structures. The present block structure also provides a vertically extending decorative surface that allows for the construction of aesthetically pleasing stair structures, elevated walkways, decks, risers and the like.

BACKGROUND OF INVENTION

The use of concrete blocks for the construction of walkways, interlocking planar surfaces and retaining wall systems is well known. There are many blocks that allow for the construction of horizontally extending surfaces, such as blocks or bricks used for walkways, patios, or other planar surfaces. For example, interlocking bricks of specific shapes are well known, and can be used to construct walkways or patios with decorative patterns. Similarly there are blocks in the prior art that allow for the construction of vertically extending walls or retaining wall systems. For example, concrete blocks that are constructed to interlock vertically are also well known, and have been used in the construction of retaining walls with vertical inclines. There are, however, no blocks in the prior art that allow for the construction of vertically elevated horizontal surfaces, so as to produce stair systems, elevated walkways and decks, and other riser systems. The present invention allows for the association of vertically extending blocks with horizontally extending blocks and results in the formation of risers, or elevated surfaces and steps. The design of the concrete block of the present invention addresses the need to create a stair system within a vertically extending surface.

DESCRIPTION OF THE RELATED ART

There are commercially available concrete blocks for the construction of vertically extending structures, such as brick walls and retaining wall systems with vertical inclines. Furthermore, there are also many commercially available concrete blocks for the construction of horizontally extending surfaces, such as walkways, interlocking planar surfaces and the like. U.S. Pat. No. 4,909,010 and corresponding Canadian Patent No. 2,012,286 issued to Robert Gravier Mar. 20, 1990 and Mar. 22, 1994 respectively, describe a concrete block for use in the construction of retaining wall systems with vertical inclines. U.S. Pat. No. 4,190,384 issued to Herwig Neurnann Feb. 26, 1980 teaches a concrete wall system directed to building slope-retaining walls for growing plants. In Canadian Patent Application No. 2,069,178 filed May 21, 1992 by Tony lacocca et al., there is disclosed a somewhat 'z-shaped' block for building retaining walls by superimposing rows of separate blocks upon each other. However, the prior art does not describe a concrete block structure that is adapted for the association of vertically extending surfaces with horizontally extending surfaces thereby resulting in the construction of secure, aesthetic concrete or brick elevated surfaces, such as stair systems or steps, riser systems for elevated walkways, decks and the like.

Although there are many variations in the prior art that propose variations in concrete blocks for the purpose of creating vertically or horizontally extending structures, there are no concrete block structures in the prior art that teach the specific concepts disclosed by the present invention.

SUMMARY OF THE INVENTION

The present invention relates to a concrete block that provides a block unit for the association of vertical and horizontal block structures for the construction of stairs or step systems, or for the construction of vertically elevated horizontal surfaces or platforms. The block structure of the present invention allows for the association of vertical and horizontal surfaces, and results in the construction of horizontally extending surfaces within a vertically extending decorative riser, wall, step, stair and the like.

The concrete block of the present invention includes a block structure with a vertically extending decorative surface that extends substantially above a rearwardly extending flat horizontal ledge which is adapted to receive and support additional bricks or blocks. The horizontal ledge portion receives and elevates additional bricks or blocks thereon, and the vertically extending decorative surface accommodates additional bricks or blocks therebehind. The horizontal ledge portion of the present invention extends rearwardly and is of an adequate elevation such that it can efficiently elevate additional bricks or blocks thereon. For example, a horizontal ledge that is too shallow or is insufficiently elevated will not serve as an adequate riser. Appropriately, the horizontal ledge of the block of the present invention must be of a significant elevation such that it can adequately serve as an efficient riser. Accordingly, in addition to providing an efficient riser, the horizontal ledge must also be of an elevation that is essentially shallower than the elevation of the vertically extending rim such that the vertically extending rim of the block of the present invention extends above the rearwardly extending horizontal surface resulting in aesthetically concealing or surrounding conventional bricks or blocks used in combination with the present invention for the construction of horizontally extending surfaces within a vertically extending structure. Therefore, the vertical rim surface of the block of the present invention extends substantially above the rearwardly extending horizontal ledge, so that conventional bricks or blocks supported by the horizontal ledge can be accommodated or concealed behind the vertically extending rim surface of the appropriate height, preferably such that the top surface of the supported bricks or blocks coincides with the level or height of the vertical extending surface of the block of the invention. In addition to providing a vertically extending surface, the outer face of the vertically extending surface can be decorated according to the builders preference such that risers, stairs or elevated step systems can be made aesthetically pleasing.

The horizontally extending portion of the present block structure includes a bottom surface suitable for placement onto a ground surface or foundation, or onto lower adjacent blocks used in the construction of stairs, steps, or riser systems. In accordance with the present invention, the horizontally extending portion of the present block structure includes a top surface suitable for supporting additional bricks placed thereon. The horizontally extending portion preferably has a top surface that is flat, however, this surface can be profiled to adapt to the blocks or bricks that it receives and supports thereon.

The block structure of the present invention resembles an "L-shaped member" such that the bottom horizontal portion can be placed onto the ground, or onto other lower blocks, or onto other supporting foundations. It is the horizontal portion of the present invention that provides an elevated horizontal planar ledge surface that receives, supports and vertically elevates other bricks or block structures placed thereon. The vertical rim surface extends normally to the horizontal body of the block structure thereby providing a decorative outer surface that encloses the elevated additional blocks therebehind. Furthermore, the outer surface of the vertically extending structure can be a flat, textured or decoratable surface that coordinates with the riser system being constructed.

In accordance with the present invention the vertically extending surface of the present block may embody an irregular shape. That is to say, although the vertically extending structure extends substantially above the rearwardly extending surface, the outer surface of the vertical structure may embody various shapes and textures. For example, the block may comprise a vertically extending surface whose outer face is an irregular, circular, geometric or angled structure of any colour or texture. According to another embodiment, the outer surface of the vertical structure of the present block may comprise an irregularly rounded, boulder like face which may exhibit a sandstone or textured surface. An advantage of irregularly shaped blocks in accordance with the present invention is these blocks allow for increased contact when used to construct rounded or contoured structures.

Another embodiment of the present invention comprises a concrete cornered or curved block with an angled or curved outer vertical surface. The curvature in the present block is not limited to right angles, instead the curvature can be designed according to the preference of the builder. For example, if the builder prefers a stair system or an elevated deck that is of a square or a rectangular shape, then corner stones according to the present invention can be constructed such that the outer vertically extending surface has a 90° angle. However, if the builder prefers a rounded or curved elevated deck or a rounded or curved stair system, the block according to the present invention can be constructed whereby the outer vertical surface embodies various curvatures, such that when the present blocks of various curvatures are put together, they produce a rounded or curved riser to the stair or deck system being constructed.

In accordance with the present invention, the vertical rim of the present block structure extends perpendicular to the horizontal ledge such that the inner junction of the vertical and horizontal structures of the block is at a right angle. However, a preferred embodiment of the present invention may include an angled inner junction at the inner interface connecting the vertical and horizontal surfaces. Since the vertical surface extends substantially above the horizontal ledge surface, a sharp right angle at the inner junction may potentially result in a structurally weak component at this interface. Therefore, it is a preferred embodiment of the present invention that the inner junction be a curved or angled inner interface, thereby providing the vertically extending surface of the present block structure with added strength and durability. For example, commercially manufactured blocks of the present invention may be produced with an integral curved or angled portion at the inner comer, thereby resulting in a curved "L-shaped" block. Consequently, an integral angled wedge or hinge at the inner interface of the vertical and horizontal surfaces would ensue additional strength to the present structure, and in particular to the vertically extending surface of the present invention.

In an additional embodiment of the present invention, a tie bar may be embedded into the block structure of the present invention. A tie bar may be of any strong, flexible material that is enmeshed into the block structure at either a vertical or horizontal portion, and projects out from the block and extends into the surrounding environment to facilitate securing the block to its surrounding environment and to confer additional stability and strength to the structure constructed with the present block.

Moreover, in accordance with the present invention, weight reduction cavities or passages that run vertically through the horizontal ledge portion can also be embodied in the present block, such that reinforcement materials or bedding gravel can be inserted therein. These vertical cavities or passages can allow for the insertion of materials that can better secure upper blocks placed onto the horizontal riser portion and to correspondingly better secure the present invention to other lower foundations. These passages can therefore contribute to the added vertical and horizontal strength of the constructed elevated system. Moreover, the vertical passages can also serve as drainage holes that permit liquids to drain from the interior of the elevated step or riser systems. For example, if the block of the present invention is used to create an outdoor brick stair system, the vertical passages that run through the present block would allow rain to drain from the interior of the stair system.

In addition, the present invention can also be used as an improved elevating border for a variety of materials and applications. For example, the present block can be used as an elevating border in various gardens, lawns, or other landscape projects. Since the present block resembles an "L-shape" figure, with a vertical surface that extends substantially above a rearwardly extending horizontal ledge, the present invention provides adequate vertical space, thereby enhancing and promoting the growth of living plants elevated therewith. That is, since the vertical surface extends significantly above the horizontal ledge portion, the present invention is better able to retain the roots of sod or garden plants within a preferred vertical border. Moreover, the vertically extending passages that run through the horizontal ledge in an embodiment of the present invention further promote and allow for the growth of various plants within the elevated system being constructed.

Moreover, since the block structure of the present invention comprises a vertically elevated surface that extends a significant distance above a rearwardly extending horizontal surface, it enables the construction of aesthetically pleasing vertically elevated horizontal structures. In addition to enabling the construction of vertically elevated horizontal structures, such as stair systems, risers and elevated platforms, the present block structure may also be used as an edger block. That is to say, in an additional use, the block of the present invention may also be used to surround or border various objects or surfaces. For example, a row of the blocks may be used as a ledge that borders a path or garden, or they may be placed in the ground in an inverted manner such that the vertical portion projects into the ground and the bottom of the horizontal portion projects upwards to thereby retain and surround a walkway or any other object.

In a preferred embodiment and application of the present invention, a stair system can be constructed using the present block and conventional interlocking bricks, such that the present concrete blocks form an adequate riser onto which interlocking bricks can be placed and elevated thereon. In addition, a geotextile layer can be used in the construction of various structures using the block of the present invention. A geotextile layer, for example, of spun polypropolene, would be a preferred barrier used to control the movement of fine particles in the base aggregate of bedding gravel placed thereon. The bedding gravel would be placed above the horizontal surface of the present invention with the geotexlite layer preferably placed therebetween.

Furthermore, in another preferred embodiment, the block of the present invention can incorporate a key-way or slot that extends longitudinally along both sides of the vertically extending structure of the present invention whereby a gasket element can be accepted therein. A gasket accepted along the sides of the block of the present invention would prevent the hydraulic movement of fine particles in the bedding or base gravel, resembling the effect of a geotextile layer. The gasket element may be made of a flexible, water insoluble material, such as spun polypropolene, that would prevent the movement of fine particles in the bedding gravel while still allowing water to filter out of the interior of the vertically extending horizontal structure.

Another application of the present invention can be the construction of an elevated patio deck or walkway. Furthermore, as described above, the present invention provides a substantial recess within which the growth of grass or plants can be promoted. Accordingly, the block of the present invention can be used to create various aesthetically pleasing decks, stairs, and walkways that can incorporate lawn or floral islands there within.

In another application of the present invention, the present block can replace capstones conventionally used in building, or can be used as the top or upper row of conventional retaining walls. Since the present block provides an improved ability to promote the growth of lawns or other vegetation, the present invention can be used as the top row of retaining walls that retain elevated lawns or that retain and extend vertically along a hill or embankment.

BRIEF DESCRIPTION OF THE DRAWINGS

Embodiments of the invention will now be described, by way of example, with reference to the accompanying drawings, wherein.

DETAILED DESCRIPTION OF THE PREFERRED EMBODIMENTS

Figure 1:
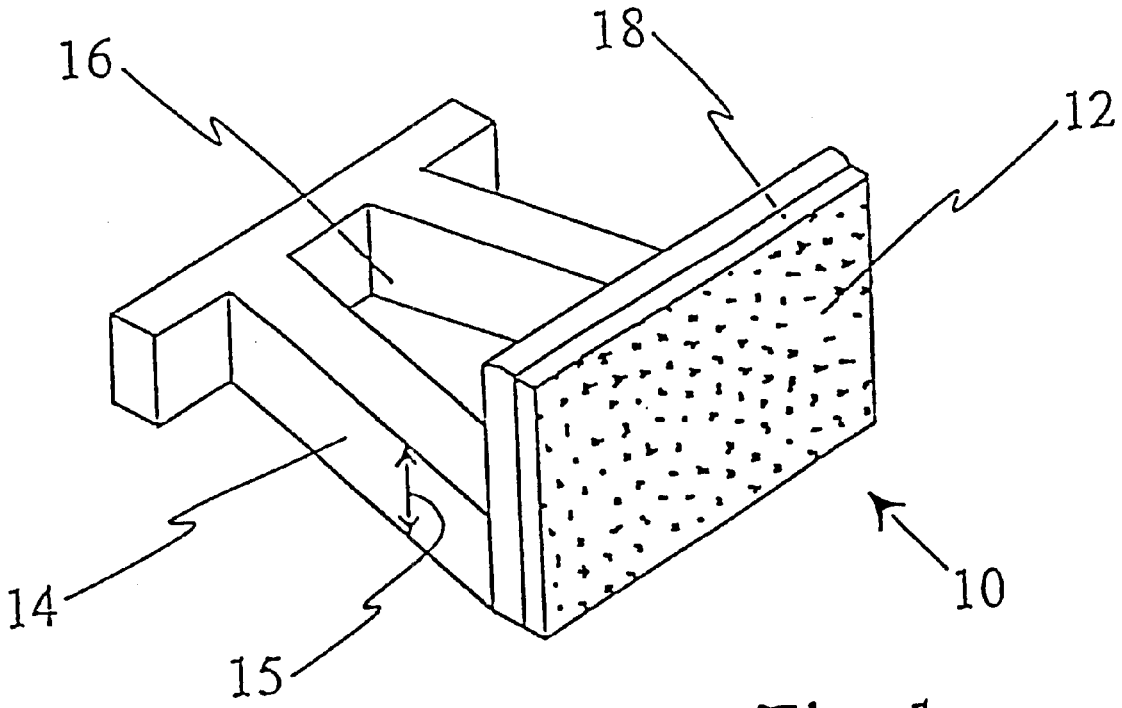
FIG. 1 is a perspective view of an embodiment of a concrete block of the present invention.

Referring to FIG. 1, there is shown a perspective view of the front side of a concrete block (10) of the present invention, which includes a horizontally extending portion (14) that projects rearwardly from the normally extending vertical surface (12). The rearward horizontally extending structure (14) provides a ledge or riser (15) onto which other conventional blocks or bricks can be placed thereon. The vertically extending surface (12) provides a flange or rim surface (18) which aesthetically conceals the elevation of conventional blocks placed therebehind. The vertical surface is of a generally rectangular configuration having a front face (rim surface) with a generally planar upper edge that is perpendicular to the front face, said vertical frontal surface member attached adjacent to a separate rear vertical member having a curved upper edge (FIG. 1) that is not perpendicular to said front face and that extends above the generally planar upper edge of said vertical frontal surface member, said vertically extending structure extending to a vertical height substantially above the horizontal structure for concealing objects therebehind. Also shown in FIG. 1 is a cavity or passage (16) that runs vertically through the rearward horizontal structure. FIG. 1 illustrates a single passageway (16), however, a plurality of passageways or cavities can be provided in accordance with the present invention, so long as the strength of the present block structure is not compromised.

Figure 2:
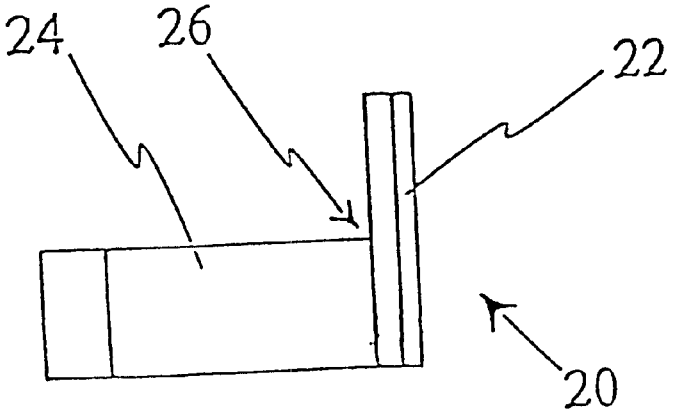
FIG. 2 is a side elevation of the concrete block of FIG. 1.

FIG. 2 illustrates a side elevation of a concrete block (20) of the present invention that may correspond to the concrete block (10) shown in FIG. 1. In FIG. 2 the vertical surface (22) extends perpendicular to the horizontally extending portion (24) such that the inner junction of both surfaces is a sharp right angle (26). It should be noted that since the vertical portion extends substantially above the rearward horizontal structure, the vertical structure should be of a sufficient depth to conceal or accommodate additional bricks. Preferably, the depth of the extension of the vertical surface (22) rising above the horizontal structure (24) should approximate that of the bricks to be laid therein. It is noted that a sharp right angle (26) at the junction of the vertical and horizontal surfaces may potentially diminish the strength of the present block. Accordingly, a preferred embodiment of the present invention would incorporate an angled or curved inner junction, as shown in FIG. 3 and FIG. 4.

Figure 3:
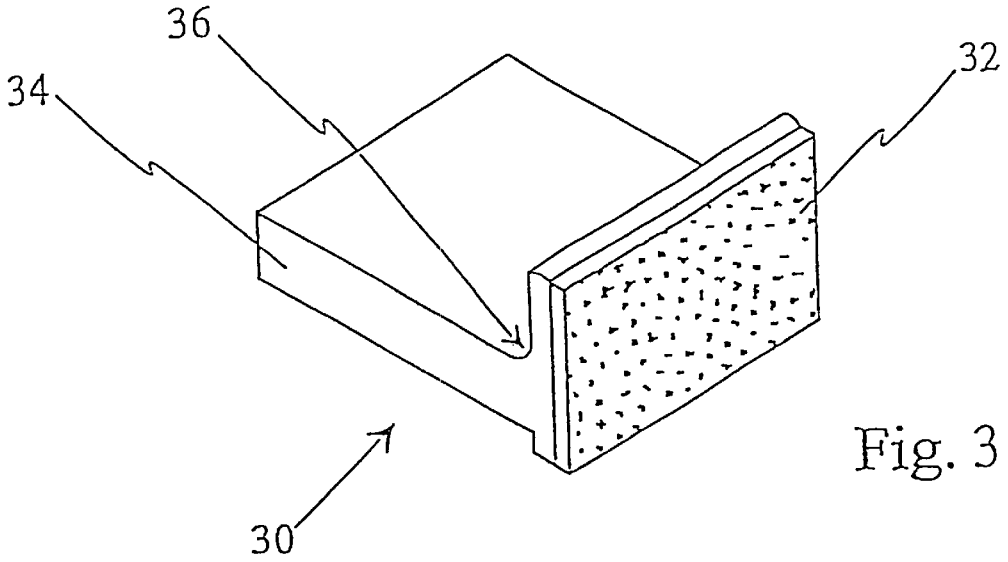
FIG. 3 is a perspective view of another embodiment of a concrete block of the present invention.
Figure 4:
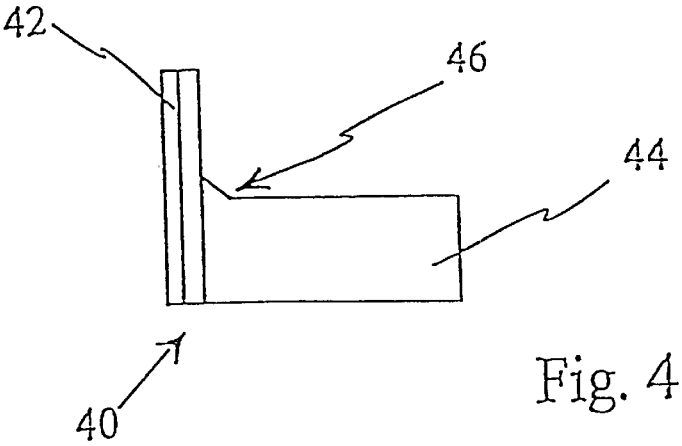
FIG. 4 is a side elevation of a concrete block according to a preferred embodiment of the present invention.

FIG. 3 and FIG. 4 both illustrate preferred embodiments of the present concrete block. FIG. 3 shows a perspective view of a concrete block (30) according to a preferred embodiment of the present invention, such that the vertical surface (32) extends perpendicular to the horizontal rearwardly extending portion (34) such that the inner junction of the vertical and horizontal surfaces is curved (36). FIG. 4 illustrates a side elevation of a concrete block (40) according to another preferred embodiment of the present invention, where the vertical portion (42) extends perpendicular to the horizontal rearwardly extending portion (44) such that the inner junction of the vertical and horizontal surfaces is angled (46). The angle at the inner junction (46) between the vertical (42) and horizontal (44) structures as shown in FIG. 4, is illustrated as an integral wedge or hinge with a 45° angle, however, any other suitable angle can be used to better reinforce the inner junction of the vertical and horizontal portions of the present block structure, so long as the strength of the present block structure is not compromised. Consequently, a curved or angled inner junction ensues additional strength to the present block. Nevertheless, it should be noted, that regardless of the curvature of the inner junction, the present invention resembles a substantially "L-shaped" block that serves as an efficient vertical riser used in the construction of various risers, steps or stair systems.

As shown in FIGS. 1 to 4, the block of the present invention consists of a vertical structure that extends substantially above a rearwardly extending horizontal structure, whereby the horizontal structure provides a suitable riser to additional blocks placed thereon, and the vertical structure provides a vertical aesthetic surface that accommodates or conceals additional blocks therebehind. Since a preferred use of the block of the present invention is for the construction of stairs, or elevated decks or walkways, the block of the present invention would be essentially used in combination with additional conventional blocks. Therefore, a preferred height or depth of the vertically extending structure above the horizontal structure would preferably be a depth that would be approximately one-half of the depth of the vertically extending structure in order to accommodate standard conventional blocks, for example, a depth of approximately 3½ inches above the horizontal ledge would be a suitable depth for accommodating conventional paving stones or interlocking bricks. Accordingly, a block according to the present invention with a horizontally extending structure of a suitable riser and a vertically extending structure with a front vertical face of approximately 7 inches, and a depth of approximately 3½ inches above the horizontal structure is preferred. A block according to the present embodiment would consist of a vertical structure that extends approximately 3½ inches above the rearward horizontal structure, whereby standard conventional blocks and other bedding material can be accommodated thereon.

In addition, to further increase the strength of the vertically extending horizontal structure, the thickness of the vertical portion may be increased. For example, if the vertical structure has a thickness of ½" and extends a vertical height of 3½" above the horizontal portion, the thickness of the vertical structure may be increased to a thickness of, for example, 1½". Moreover, if the vertical structure extends a significant distance above the horizontal structure, it is preferred that the thickness of the vertical structure be increased, such that the vertical structure is substantially strong.

Figure 5:
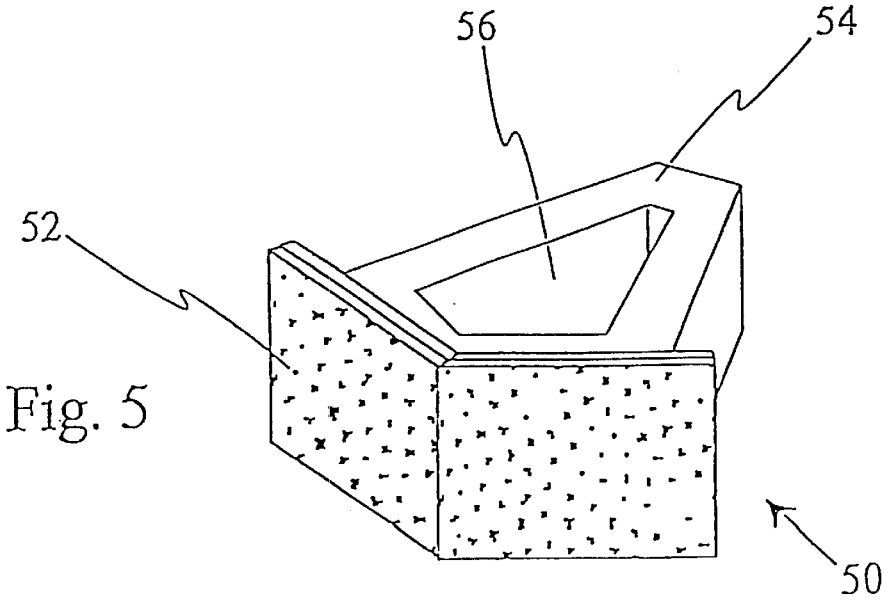
FIG. 5 is a perspective view of another embodiment of a concrete block of the present invention.

FIG. 5 illustrates a concrete block (50) structure according to another embodiment of the present invention in which the outer surface of the present block structure may be curved or angled to accommodate curves or corners. It should be noted therefore, that a concrete block according to the present invention is not limited to a block structure with a single plane outer surface, instead the present invention embodies a concrete block that can incorporate various angles and curvatures. As can be seen in FIG. 5, the concrete block (50) illustrated consists of an angled exterior vertical surface (52) and a rearwardly tapered horizontal extending structure (54) that may contain a cavity or passageway (56) that runs vertically through the horizontal structure (54). The horizontally extending structure (54) is illustrated as a rearwardly tapered structure, since the present angled block may be used within a curved or angled elevated riser system or stair. It should be noted however, that a rearwardly extending horizontal ledge structure according to the present invention need not be tapered. It may be of a rectangular shape, or any other shape that is necessary to accommodate the desired curvature needed for the construction of specific elevated systems.

Figure 16:
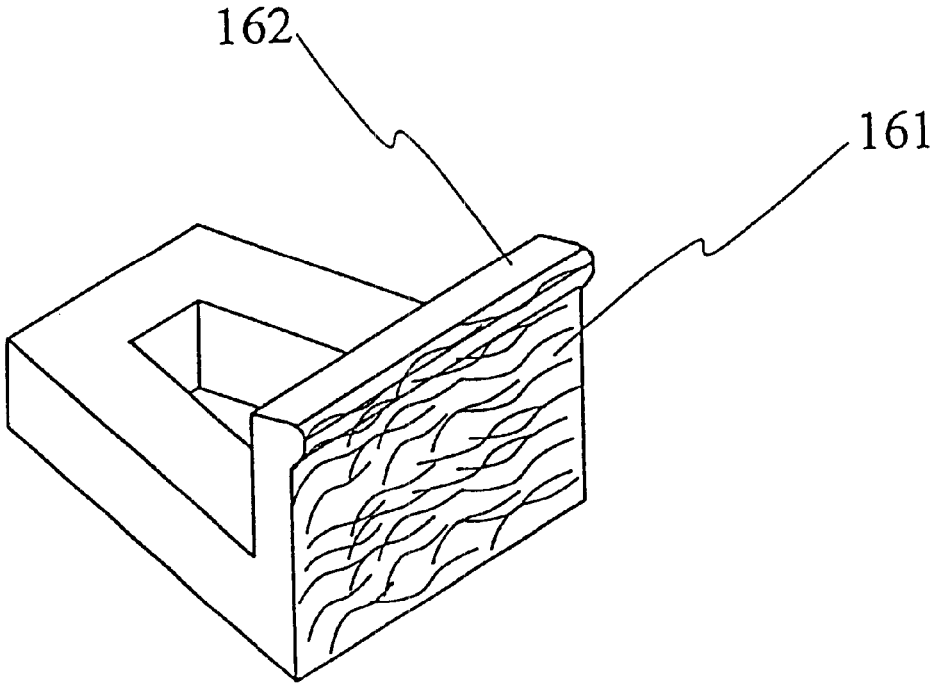
FIG. 16 is a perspective view of another embodiment of the present invention.

FIG. 16 illustrates an additional embodiment of the present block structure, wherein the outer vertical face (161) comprises an upper textured protruding rim or ledge structure (162). However, as stated above, the outer vertical face, and more broadly, the vertically extending portion of the present block structure may embody any preferred shape or texture, or any combination of various shapes or textures.

Figure 15:
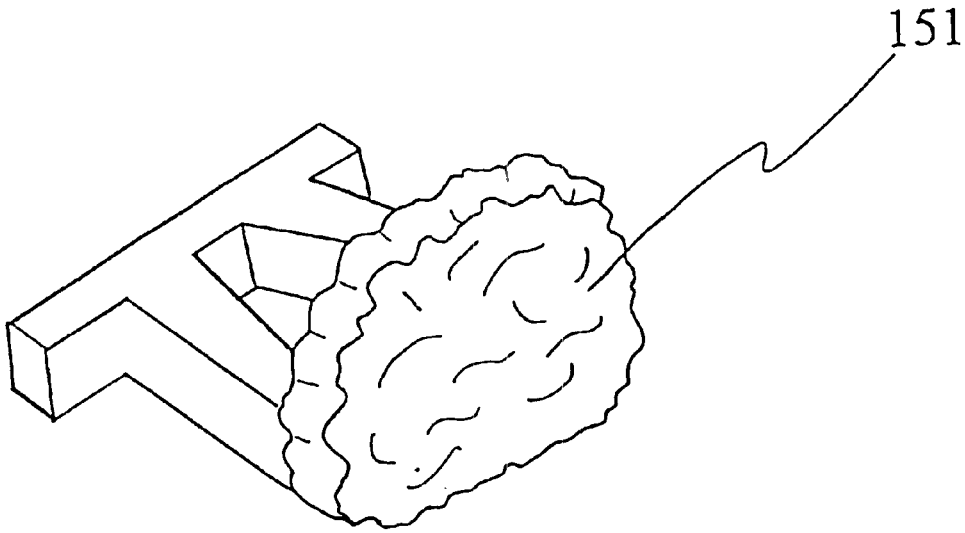
FIG. 15 is a perspective view of another embodiment of the present invention.

FIG. 15 illustrates an embodiment of the present block structure, wherein the outer face of the block embodies an irregularly shaped boulder-like structure. Although the outer surface of the vertical structure (151) in the present embodiment is illustrated as an irregularly rounded, textured, or sandstone surface, the outer face of the vertical structure may be of any desired shape or texture. Irregularly shaped outer surfaces allow for greater contact surface area, when compared to square or rectangular blocks, and may preferably be used to create rounded or curvilinear borders or edges, or for smoother contours on elevated profiles when making a grade transition.

For example, if a circular stair system or deck is preferred, concrete blocks according to the present invention may embody a circular shape, such that the outer vertical surface is a vertically extending structure with a circular circumference. Accordingly, the rearwardly extending horizontal structure should be of a shape that would allow for the lateral association of blocks into the preferred elevated structure.

In accordance with the present invention, the present block structure may be used essentially for the construction of steps or stairs, or elevated decks or walkways. However, the present invention may further be used for the construction of other elevated structures. The present block may be preferably used in combination with different conventional blocks such that the present invention may allow for the association of vertical and horizontal surfaces, and in particular for the facility to construct horizontally extending surfaces or platforms within a vertically extending structure. For example, in the construction of a stair system, a block structure according to the present invention could be used to elevate and receive conventional interlocking bricks thereon, such that each elevated horizontal surface of each step would be supported by the rearwardly extending horizontal structure of the present block, while the vertically extending structure of the present invention would provide the outer surrounding border of each step. Similarly, the present invention may be used to allow for the construction of a horizontally extending platform or stage or step and the like within a conventional vertically extending wall.

Figure 6:
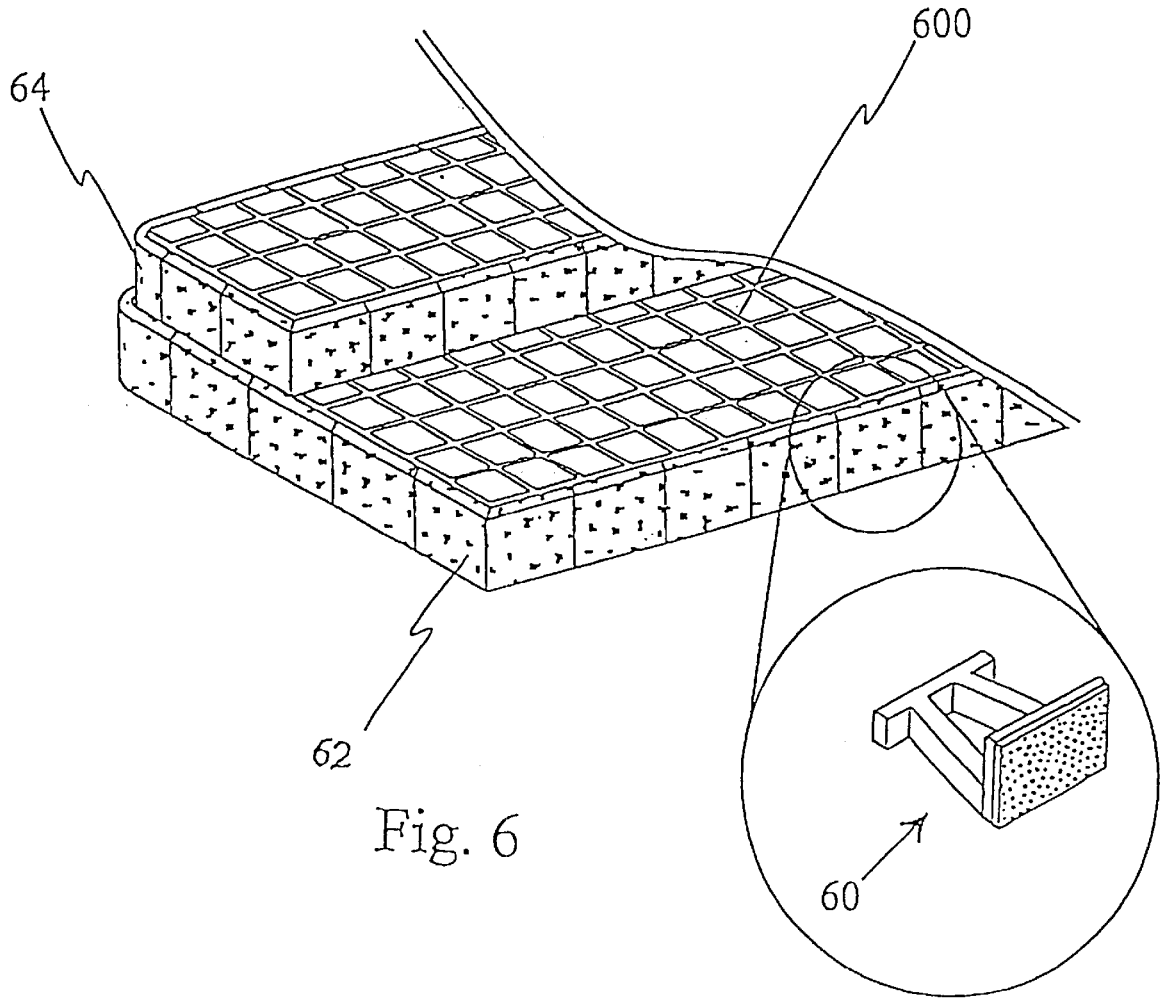
FIG. 6 is a perspective view of a stair system utilizing blocks embodying the present invention.

FIG. 6 illustrates the above described application of the present block structure in combination with conventional interlocking bricks. As shown in FIG. 6, blocks according to the present invention are shown to encompass a variety of shapes: a single plane block (60), an angular corner block (62) and a curved corner block (64). Also shown in FIG. 6, is the cooperation of blocks according to the present invention with conventional interlocking blocks (600). The blocks according to the present invention, as shown in FIG. 6, provide a riser upon which conventional blocks can be placed. The block of the present invention comprises a vertical structure that extends substantially above a rearwardly extending horizontal structure, such that the vertically extending portion of the present block can enclose or conceal laterally co-operating conventional blocks placed thereon, thereby allowing for the construction of aesthetically pleasing stair systems or other elevated horizontal surfaces. A preferred embodiment of a single plane vertical face block according to the present invention, as shown in FIG. 1, block (10) and FIG. 6, block (60) is preferred for practical reasons, since the rear lateral extensions of the horizontal structure could be removed or broken off on site whenever required, thereby contributing to the improved practical use of the block according to the present invention.

Figure 7:
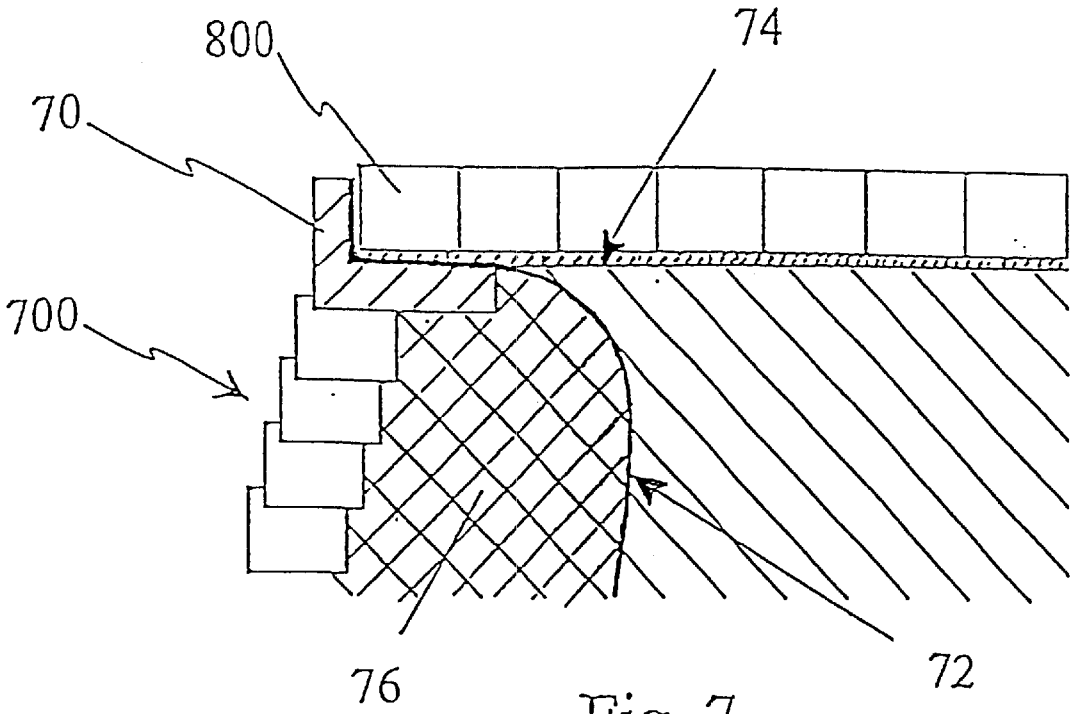
FIG. 7 is a side sectional view of another preferred application of the present invention.

A geotextile layer installed below the bedding gravel and above the horizontal surface of the present invention would confer additional stability to vertically extending horizontal structures as illustrated in FIG. 7. A geotextile layer is essentially a fabric barrier used to control the hydraulic movement of fine particles in the base aggregate or bedding gravel. Therefore, in the construction of vertically extending horizontal structures using the block of the present invention, it is preferred that a geotextile layer be additionally used. The geotextile layer would run along the inner surface of the vertically extending structure of the present invention and down along the top of the horizontal structure of the present invention and then extend down towards the base of the elevated structure. The geotextile barrier would support the base aggregate or bedding gravel, and prevent the hydraulic movement of the aggregate material. Furthermore, the geotextile layer would prevent the erosion of fine bedding gravel, and would prevent dust or fine particles from passing through the structure. Therefore, a geotextile layer would contribute additional support to vertically extending structures that use the block of the present invention, and would provide the horizontal and vertical surfaces with enduring stability.

Figure 12:
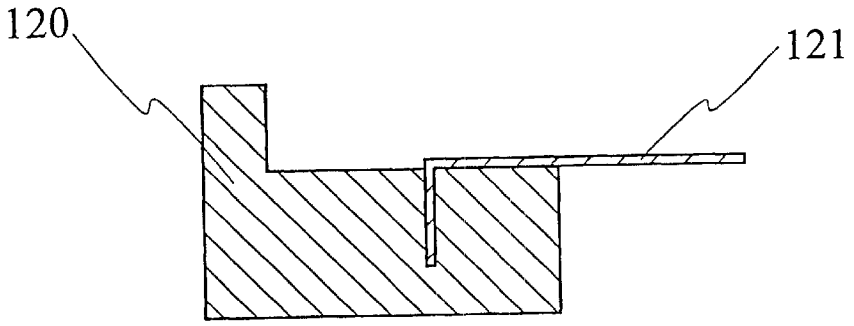
FIG. 12 is a cross sectional view of an embodiment of a concrete block with a tie bar embedded therein.

In an additional embodiment of the present invention, a tie bar ( 121) may extend from the rearwardly extending horizontal portion, as illustrated in FIG. 12, or from the vertically extending portion of the present block structure. A tie bar, as referred to herein, describes a strong flexible element that facilitates fastening or securing the block of the present invention to its surrounding environment, for instance, earth or concrete. The tie bar may be a metal material, a rubber or rigid polymer, or any other material that exhibits strong, resilient and flexible properties. Moreover, the tie bar may be a narrow bar, a pipe or rod, a flattened rod or arm, an elongated sheet, an extending handle, a stake or shaft, or any other suitable shape that allows for the insertion or accommodation of the block embedded tie bar into the surrounding environment.

Figure 13:
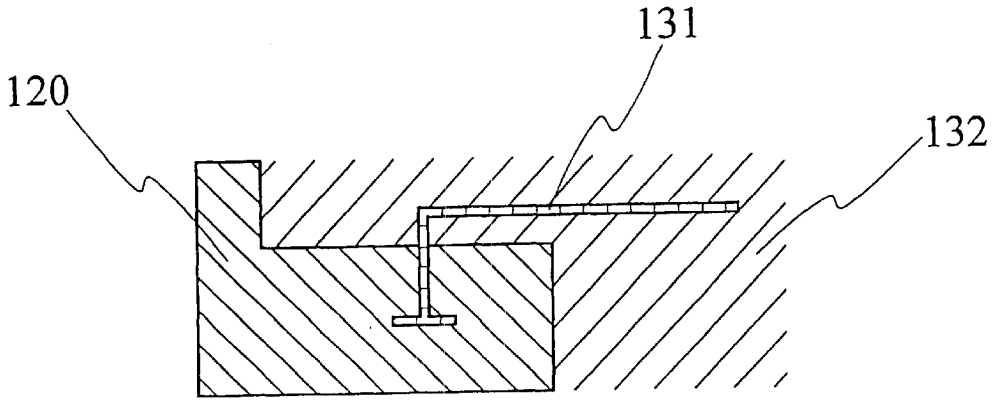
FIG. 13 is a cross sectional view of another embodiment of a concrete block with a tie bar extending into surrounding surface.

In accordance with the present embodiment, a tie bar may be embedded into the horizontal or vertical portions of the present block structure such that the tie bar extends from the block structure into the surrounding environment. Accordingly, the present block may be manufactured or produced with a minor portion (the lesser portion) of the tie bar embedded within the horizontal or vertical portions of the block, while the major portion of the tie bar extends out therefrom. As illustrated in FIG. 12, the tie bar may be a straight or linear bar that extends from the horizontal portion of the present block, or it may comprise a curved or "T-shaped" end, as illustrated in FIG. 13, which may anchor or embed the tie bar into the block structure in a stronger manner.

In accordance with the present embodiment, the block embedded tie bar may extend from the horizontal or vertical portions of the present block at any position. For example, if the tie bar extends from the rearwardly extending horizontal portion, it may be enmeshed or embedded into the horizontal portion of the block at any position. For example, the tie bar may be embedded to extend from the horizontal portion at a half way position, that is to say, between the inner junction of the vertical and horizontal structures and the rear edge of the horizontal structure, or it may extend, for example, at a position near the back or rear edge portion of the horizontal structure. Alternatively, the tie bar may be embedded into the vertically extending portion of the present block structure at any position along the vertically extending portion. For example, the tie bar may be embedded at the centre of the vertically extending portion, or at an upper portion of the vertically extending structure. However, it is preferred in the present embodiment that the block embedded tie bar be embedded in the present block in a manner that does not weaken the present block structure. Therefore, in a preferred embodiment, such that the enmeshment or addition of a tie bar into the present block structure does not generate a weakened block structure, the tie bar should preferably extend from the rearwardly extending horizontal portion of the present block structure.

Figure 14:
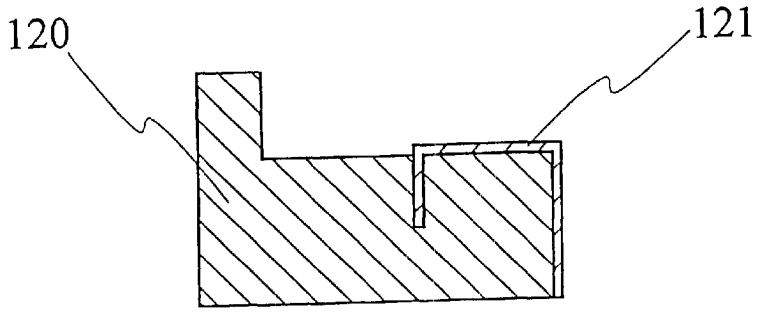
FIG. 14 is a cross sectional view of a concrete block a block with tie bar in an unextended position.

In a preferred embodiment, the tie bar comprises a flattened narrow rod or bar comprised of, or shaped from, a flexible metal material, that extends from a rearward central position in the horizontal portion of the present block structure, wherein, the tie bar may be shaped or bent into the desired position upon use. For example, according to the present embodiment, a block that comprises a tie bar may be manufactured such that the tie bar extends from the horizontal portion of the block and is bent about the contour of the horizontal portion, thereby allowing for easy storage and shipping of the block as illustrated in FIG. 14. Upon use, the tie bar may be bent up to extend parallel to the horizontal structure as illustrated in FIG. 12. As illustrated in FIG. 13, the tie bar may be bent to extend a suitably elevated distance, parallel to the horizontal portion of the block so that it may be project into the surrounding environment (132), thereby further fastening the present block structure to the surrounding environment, and consequently conferring stability to a structure comprised of the present block.

In accordance with the embodiments of the present invention, the block may or may not include a tie bar. Since the block of the present invention may be used for the construction of various structures, dependent on the use thereof, a block comprising a tie bar may be preferred to a block without a tie bar. For example, if concrete or earth are elevated and received upon the horizontal structure and concealed behind the vertical structure, a block comprising a tie bar may be preferred since the tie bar will fasten and additionally secure the block into the surrounding cement or earth environment. However, if the user wishes to overlay conventional interlocking bricks onto the block according to the present invention, a tie bar may not necessarily be needed. Therefore, the block according to the present invention may embody a block that does not comprise a tie bar, or if the block according to the present embodiment does comprise a tie bar, the tie bar may be bent about the contour of the brick such that it does not interfere with objects placed thereon.

Figure 9:
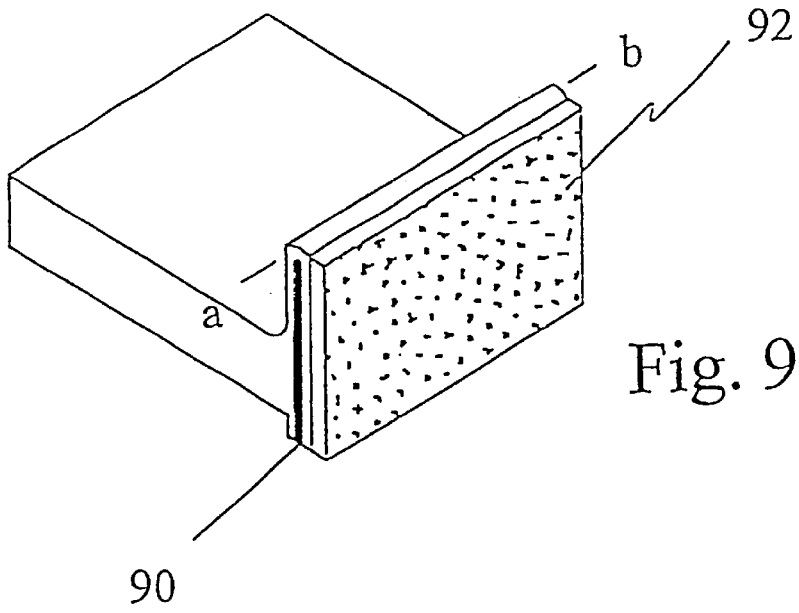
FIG. 9 is a perspective view of another embodiment of a concrete block of the present invention.
Figure 10:
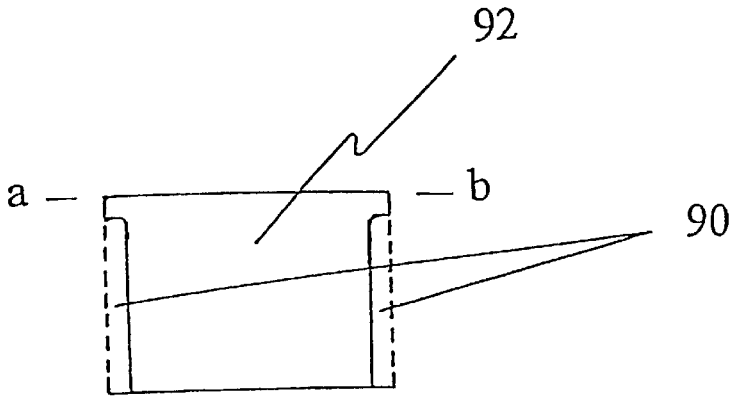
FIG. 10 is a cross sectional view along a-b of the concrete block of FIG. 9.
Figure 11:
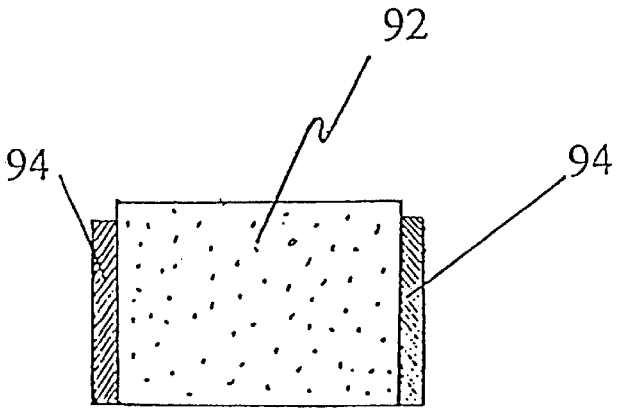
FIG. 11 is a cross sectional view of the vertical extending structure of an additional embodiment of a concrete block according to the present invention.

In another preferred embodiment of the block of the present invention as illustrated in FIG. 9 and FIG. 10, a key-way or slot (90) that extends longitudinally up along both sides of the vertically extending structure (92) is incorporated whereby a gasket element can be accepted therein. Alternatively, instead of manufacturing a block according to the present invention with vertical slots for accepting an independent gasket element, the block of the present invention can be manufactured with an integral gasket element (94) as illustrated in FIG. 11. Therefore, additional embodiments of the block of the present invention include a block with key-way slots (90) that run up along the vertical sides of the block of the present invention that allow for the acceptance an independent gasket element therein, or a block with an integral gasket element (94) manufactured to extend from within the vertically extending surface (92) and protrudes up along the vertical sides of the block of the present invention. Nevertheless, regardless of whether or not the gasket is an independent or integral element of the block of the present invention, the gasket would essentially prevent the hydraulic movement of fine particles in the bedding or base gravel. Comparable to a geotextlile layer, the gasket element may preferably be made of flexible, water insoluble materials, such as spun polypropolene, that would prevent the movement of fine particles in the bedding gravel while still allowing water to filter out of the interior of the vertically extending horizontal structure.

FIG. 7 illustrates another application of a block structure according to the present invention in combination with conventional blocks. For example, as shown in FIG. 7, the present block structure (70) can be used as the top or upper layer of a conventional vertically extending retaining wall (700), such that the present invention receives conventional blocks (800), and allows for the construction of a horizontally extending platform within a vertically extending wall. Therefore, in accordance with the present embodiments, the block structure of the present invention allows for the construction of horizontally extending platforms within vertically extending structures. Accordingly, the block structure of the present invention permits the construction of various systems that incorporate horizontally extending surfaces within elevated vertical surfaces. For example, the present block structure can be used in combination with conventional blocks to construct a single level step, or a multi-level stair system, an aesthetically pleasing or artistic riser system, or a creative multi-level deck system, or for the construction of any other structures that combine vertical and horizontal surfaces. Furthermore, as described above, a geotextile layer may preferably be placed between the block of the present invention and the bedding gravel, such that the geotextile layer would prevent the hydraulic movement of fine particles of the base or bedding gravel. Therefore, an additional application, as shown in FIG. 7, the block of the present invention (70) could comprise the upper row of a conventional vertically extending retaining wall (700), a geotextile layer (72) would preferably overlay or cover the inner vertical and horizontal surfaces of the present invention and extend downwards. The bedding gravel (74) would be placed onto the geotextile layer and conventional blocks (800) would be inserted thereon. It should be noted that preferably, crushed gravel (76) would be placed below the geotextile layer beyond the block surfaces, whereby the crushed gravel would confer additional support to the vertically extending horizontal structures.

An additional advantage of constructions or structures comprised of blocks of the present invention, is that the present block confers, or permits, environmental or climatic flexibility to a vertically elevated horizontal structure in accordance with the present invention. That is to say, since preferred embodiments of the present invention avoid using cement-to-cement contacts, the vertically extending horizontal structures of the present invention allow structural stability throughout changes or fluctuations in temperature. Therefore, a structure constructed with the present block structure and according to preferred embodiments will sustain changes and fluctuations in temperature while precluding or minimizing any structural cracking or fractures.

It is preferred that cement-cement contacts be avoided in the construction of vertically elevated horizontal structures according to the present invention. Although, the present invention does not require that all cement-cement contacts be absent, it is preferable to avoid the use of cement-cement contacts, whereby cracks or fractures within the present structures are precluded or minimized. It is preferable, that a bedding gravel layer, for example, a bedding gravel with a maximum aggregate of ¼", such as a crusher dust, be placed between the block of the present invention and the conventional blocks placed thereon. Therefore, the bedding gravel would be placed onto the horizontal structure of the present block, and conventional blocks would be subsequently placed thereon. In addition, to further stabilize the present structure, and to eliminate the easy removal of blocks from the present construction, fine silica, with, for example, a calibre of 0.5mm, may be swept in between the overlaying bricks. The fine silica will subsequently knit the bricks tightly, thereby precluding their facile removal.

In addition to the application of the present invention as a block structure that permits the construction of horizontally extending decks or platforms and the like, the present block can also be used to form a top or upper row of conventional retaining walls or vertically extending borders that retain sod or other various plants. Since the present invention consists of a substantially extending vertical structure that can adequately accommodate the proper growth of grass or other plants, the present block can preferably be used as the top row of vertical structures that retain or surround various slopes, lawns or landscapes that include plants and the like. Therefore, for example, the present invention can be used in combination with conventional extending walls that retain elevated lawns, slopes, or embankments, or in combination with vertically extending landscape designs, such that the present invention is used as the top or upper row, whereby the present invention allows for an agreeable support and growth of lawns, plants or other vegetation.

For example, if a landscape project included a vertically extending structure that culminated with a horizontal platform upon which a flower bed was requested, the present invention would allow for the construction of such a structure. Whereby the present invention allows for the construction of a horizontally extending platform within the vertically extending structure such that a flower bed grown thereon would be adequately supported, since the present block consists of a substantially extending vertical surface that can accommodate the proper growth of flora. It should be noted that FIG. 7 illustrates a horizontal platform comprised of conventional bricks (800), however the conventional vertically extending retaining wall (700) can consist of an upper row incorporating blocks of the present invention (70), whereby the horizontal surface supported is sod, plants, or other vegetation (not shown). The block of the present invention is favourable for such an application because the vertically extending structure provides a suitable amount of vertical space that can adequately accommodate the proper growth of various plants and vegetation.

Figure 8:
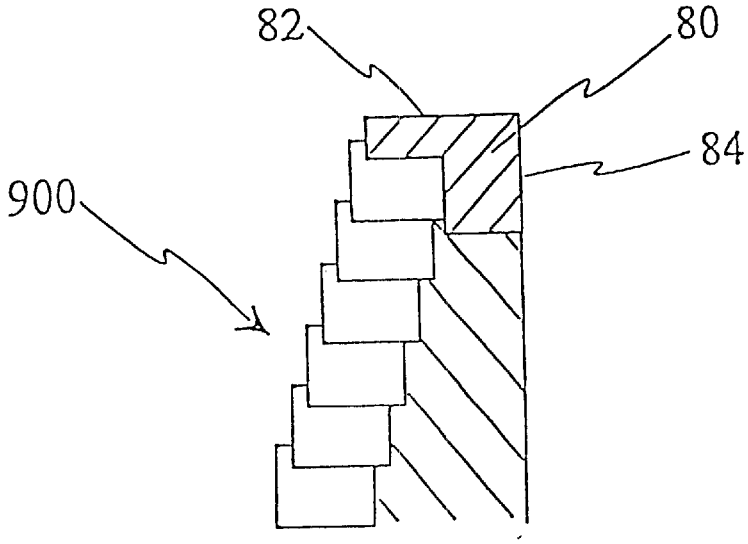
FIG. 8 is a side sectional view of yet another preferred application of the present invention.

FIG. 8 illustrates yet another application of the present invention, in which the block structure of the present invention can be used as a capstone on the top or upper row of a vertically extending conventional retaining wall. Since the present invention embodies a block structure (80) comprised of an optionally decorated vertical surface (82) that extends substantially beyond a horizontally extending surface (84), the present invention can be used to cap other conventional vertical structures, such as a vertically extending retaining wall (900). Depending on the conventional block used in the construction of a prior art vertical wall, the present block structure can compliment the upper conventional block such that the vertically extending structure is capped, thereby replacing the need for conventional capstones.

Moreover, unlike block structures described in the prior art, the block structure of the present invention comprises a vertically elevated structure that extends a significant distance above a rearwardly extending horizontal structure, thereby enabling the elevation and support of objects thereon the horizontal structure and the concealment of said objects therebehind the vertically extending structure, to enable the construction of aesthetically pleasing vertically elevated horizontal structures. In addition to enabling the construction of vertically elevated horizontal structures, such as stair systems, risers and elevated platforms, the present block structure may also be used as an edger block. That is to say, in an additional use, the block of the present invention may also be used to surround or border various objects or surfaces.

For example, the horizontal portion of the present block may be inserted at or below the ground surface such that it may support and border a path, comprised of other bricks or blocks, to thereby provide a path whose bordering edge is supported by blocks according to the present invention. Alternatively, the block may be inserted into the ground in an inverted manner such that the vertical portion projects into the ground, and the bottom of the horizontal portion projects upwards, and the present block structure may retain, surround and border a path or walkway, comprised of other bricks or blocks at the ground surface.

In another preferred use of the present block, the horizontal portion of the present block may be arranged about an object, such that the present block may elevate, surround or border the object. For example, the present block may be used as an edger block to surround the perimeter of an elevated garden. In the present block, the vertically extending portion extends a substantial distance above the rearwardly extending horizontal structure, thereby allowing for support and stability in the retention of objects therebehind. In addition, since the vertically extending portion extends a substantial distance above the rearwardly extending horizontal structure, the present block provide an adequate space and depth for the growth of vegetation thereon. Unlike other conventional blocks in the prior art, the present block not only allows for the elevation of objects, but allows for the secure and adequate accommodation of a variety of objects behind the vertically extending structure.

While preferred embodiments have been shown and described, it will be understood that there is no intent to limit the invention to such disclosure, but rather it is intended to cover all modifications, combinations and alternate applications falling within the spirit and scope of the invention.

I claim:

1. A concrete landscaping block for use in the construction of laterally extending elevated structures, comprising;

a rearwardly extending horizontal structure having a vertical height suitable for the elevation of objects a substantial vertical distance and a horizontal ledge having a support length adapted to support and elevate objects thereon; and a vertically extending structure comprising a vertical frontal surface member of a generally rectangular configuration having a front face with a generally planar upper edge that is perpendicular to said front face, said vertical frontal surface member attached adjacent to a separate rear vertical member having a curved upper edge that is not perpendicular to said front face and that extends above the generally planar upper edge of said vertical frontal surface member, said vertically extending structure extending to a vertical height substantially above the horizontal structure for concealing objects therebehind;

wherein said concrete landscaping block allows for the association of vertical and horizontal surfaces for the construction of aesthetically pleasing laterally extending elevated structures; and wherein said support length has a dimension that is greater than the vertical height of said vertically extending rim.

2. A concrete landscaping block according to claim 1, wherein said horizontally extending structure comprises bottom, top, rear and side surfaces, wherein said bottom surface is suitable for placement onto a lower structure, or onto lower adjacent concrete landscaping blocks used in the construction of a riser system;

said top surface is flat or profiled to adapt to objects received and supported thereon; and said rear and side surfaces extend a suitable vertical depth or length thereby providing a suitably elevated laterally extending riser ledge.

3. A concrete landscaping block according to claim 1, wherein said vertically extending structure extends normally to said rearwardly extending horizontal structure; and wherein said vertically extending structure extends substantially twice the height above the rearwardly extending horizontal structure for concealing objects therebehind.

4. A concrete landscaping block according to claim 3, wherein the vertically extending structure is curved, thereby allowing for the construction of laterally extending elevated structures of various angles and curvatures.

5. A concrete landscaping block according to claim 1, wherein said vertically extending structure of said concrete landscaping block has a shape that is selected from the group of a square, rectangular, or a curvilinear shape for the construction of laterally extending elevated structures of various angles and curvatures.

6. A concrete landscaping block according to claim 3, wherein the front face of said vertically extending structure embodies an irregularly shaped or textured surface.

7. A concrete landscaping, block according to claim 1, wherein said concrete landscaping block has a side profile that resembles an "L-shaped" member, and wherein the inner junction at the interface of the vertical and horizontal structures is a right angle, or is an angled or curved inner junction.

8. A concrete landscaping block according to claim 1, wherein said rearwardly extending horizontal structure comprises weight reduction cavities that run vertically through the horizontal ledge.

9. A concrete landscaping block according to claim 8, wherein granular materials may be inserted into said cavities.

10. A concrete landscaping block according to claim 1, wherein a geotextile layer is placed above said rearwardly extending horizontal structure and functions as a barrier for the control of movement of fine particles in a base aggregate of bedding gravel on which said concrete landscaping block is positioned.

11. A concrete landscaping block according to claim 10, wherein said geotextile layer comprises a flexible, water insoluble material.

12. A concrete landscaping block according to claim 10, wherein said geotextile layer comprises spun polypropolene.

13. A concrete landscaping block according to claim 1, wherein a gasket is positioned along both sides of the vertically extending structure to prevent hydraulic movement of fine particles in the bedding or base gravel on which said concrete landscaping block is positioned.

14. A concrete landscaping block according to claim 13, wherein said gasket element comprises a flexible, water insoluble material.

15. A concrete landscaping block according to claim 13, wherein said gasket element comprises spun polypropolene.

16. A concrete landscaping block according to claim 1, wherein the front surface of The vertically extending sucre comprises a slot extending longitudinally up along both sides of the vertically extending structure to accept a gasket for preventing the hydraulic movement of fine particles in bedding gravel while still allowing water to filter out of the interior of the vertically extending structure.

17. A concrete landscaping block according to claim 1, wherein said concrete landscaping block further comprises a tie bar embedded into a portion of said block and which protrudes from said concrete landscaping block and is bent to extend rearwardly, thereby providing an anchoring means for stabilizing said concrete landscaping block, and structures constructed therewith, to the surrounding environment.

18. A structure comprising a plurality of concrete landscaping blocks according to claim 1.

19. A structure according to claim 18, wherein said concrete landscaping block is made from a material that allows for temperature or environmental fluctuations while precluding or minimizing any structural damage to said structure.

* * * * *